US005556164A

United States Patent [19]

Cindea et al.

[11] Patent Number: 5,556,164

[45] Date of Patent: Sep. 17, 1996

[54] PEDESTAL SEAT

[76] Inventors: Earl Cindea, 6024 Pine Creek, N.W., North Canton, Ohio 44720; Thomas Farnsworth, P.O. Box 909, Hartville, Ohio 44632

[21] Appl. No.: 321,797

[22] Filed: Oct. 12, 1994

[51] Int. Cl.[6] ..... A47C 1/023

[52] U.S. Cl. ..... 297/344.22; 297/423.38; 248/425

[58] Field of Search ..... 297/344.22, 344.21, 297/423.38; 248/283, 425

[56] References Cited

U.S. PATENT DOCUMENTS

| | | | |
|---|---|---|---|
| 1,059,856 | 4/1913 | Fox | 248/283 |
| 3,186,761 | 6/1965 | Propst | 248/425 |
| 3,708,203 | 1/1973 | Barecki et al. | 297/344.22 |
| 4,062,588 | 12/1977 | Draney | 297/344.21 |
| 4,148,524 | 4/1979 | Guyton | 297/423.38 |

OTHER PUBLICATIONS

The Original Swing–Out Seats, Swing–Way Inc. — Copyright 1990.

*Primary Examiner*—Peter M. Cuomo
*Assistant Examiner*—Anthony D. Barfield

[57] ABSTRACT

A pedestal seat for supporting the weight of a user at a work station includes a seat and a pedestal which is secured to the floor adjacent the work station, and a support arm pivotally mounted on the pedestal and connected to the seat. The pedestal includes a vertically extending column and a base integrally connected to the column. The base extends symmetrically outwardly on both sides of the column and a reinforcing flange extends between the top of the column and an end of the base with a reinforcing web of reduced material thickness extending between the flange and the column and base. A footrest is movably mounted on either side of the reinforcing web. The column is formed integrally with the base intermediate the sides, with the base and column being symmetrical about a vertical plane which passes through the center of the column. The base extending outwardly equally on both sides of the column, in combination with the reinforcing flange and web, combine to provide sufficient torsional stability such that the seat may be rotated either to the right or to the left of the base and column enabling the pedestal seat to be mounted either at the left or right of a work station.

16 Claims, 4 Drawing Sheets

PEDESTAL SEAT

BACKGROUND OF THE INVENTION

1. Technical Field

The invention relates to commercial seating. More particularly, the invention relates to pedestal seating for use when an individual is required to alternately sit and stand during the performance of the duties associated with a job. Specifically, the invention relates to pedestal seats secured to the floor adjacent a counter for rotatably supporting a seat.

2. Background Information

Many individuals are required to alternatively sit and stand at the performance of duties associated with a job. Specifically, individuals that work as bank tellers, or workers at drive-up windows, toll and guard booth operators, and research laboratory technicians all alternatively stand and sit in the performance of their duties.

This constant movement between standing and sitting can create counter fatigue significantly reducing employee productivity. Moreover, the height disparity between standard seating and standard countertops creates additional problems for individuals working at these jobs. While elevating seating is available for use with these elevated countertops, they are prone to tipping, and are generally only usable with countertops in a relatively small height range.

Standard seating creates additional problems when used in this environment in that the individual must continually check for chair position before moving from the standing to the seated position further reducing the user's productivity.

To alleviate the problems discussed above, and to speak to the specific needs of workers in these environments, seats have been developed which are securely mounted to the floor of the work area adjacent the countertop to prevent the seat from moving as the user alternatively moves between standing and sitting positions. Moreover, these devices provide that the seat may be rotated about the pedestal base to a comfortable position, with that comfortable position then being locked to assure that the seat cannot move relative to the pedestal. In this manner, the position of the seat remains constant relative to the countertop to reduce the need for the user to continually check for the seat position as the user moves from the standing to the seated position. Additionally, existing seats may be adjusted to a comfortable height relative to the countertop and thus are usable with countertops and work stations having a wide range of sizes, heights and configurations. Existing pedestal seats solve many of the problems encountered by individuals frequently moving between standing and sitting positions in the performance of their duties. Moreover, existing pedestal seats have alleviated the need to stock a significant number of different seats for use with countertops having different heights, size and configurations.

While the above discussed pedestal seats are presumably adequate for the purpose for which they are intended, the manufacturer and supplier must still manufacture and stock a number of separate models in order to supply a seat for all mounting positions. Specifically, the existing pedestal style seats are right and left handed with one seat having a right hand mount pedestal and a chair that swings left, and another seat having a left hand mount pedestal with a chair that swings right. This design is presumably adequate for the purpose for which it was intended, but requires the manufacture to stock multiple style seats increasing overhead, as well as complicating the installation and ordering process.

Therefore, a need exists for a universal pedestal style seat in which a single pedestal may be mounted to the right or to the left of the final seat position, such that the single pedestal is used regardless of the seat's position relative to the countertop.

SUMMARY OF THE INVENTION

Objectives of the invention include providing a seat having a pedestal that is securely mounted to the floor.

A further objective is to provide such a pedestal seat in which the seat may be rotated relative to the pedestal to any convenient location relative to a countertop.

A still further objective is to provide such a pedestal seat where the pedestal may be mounted either to the right or to the left of the most convenient seat position.

Yet another objective of the invention is to provide such a pedestal seat in which the pedestal stabilizes the seat, when supporting the weight of the user, regardless of whether the pedestal is mounted to the right or to the left of the seat and seated user.

Yet another objective is to provide such a pedestal seat having a pedestal which provides rotational movement of the seat either to the right hand side, or left hand side of the pedestal.

Yet another objective is to provide such a pedestal seat in which the right and left side thereof are symmetrical about a vertical plane passing through the center of the pedestal.

A still further objective is to provide such a pedestal seat which is of a simple construction, which achieves the stated objectives in a simple, effective and inexpensive manner, and which solves problems and satisfies needs existing in the art.

These and other objectives and advantages of the invention are obtained by the improved pedestal seat, the general nature of which may be stated as including a pedestal having a base adapted to be attached to a support surface, and a column extending vertically upwardly from said base; a seat; a swing arm connected to the seat; pivot means for pivotally mounting the seat in a cantilever fashion on the pedestal by the swing arm; and said column and pivot means being located in a vertical plane which extends through a center of the base with said base being symmetrical about said plane, when the pedestal is attached to the support surface.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Figure 8:
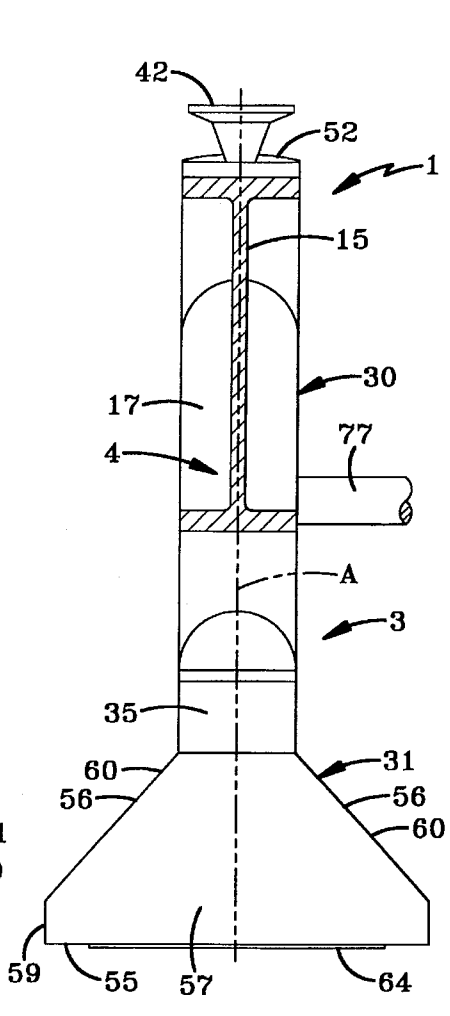
Figure 7:
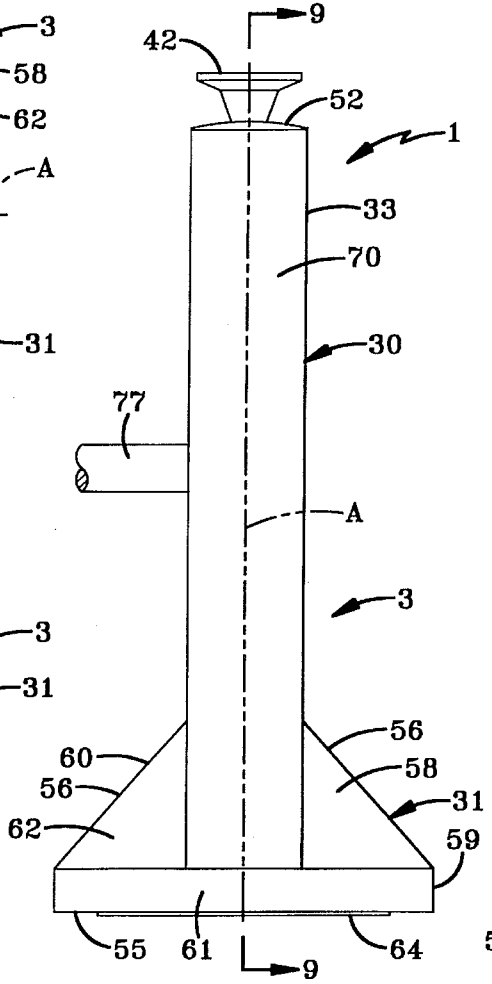
Figure 3:
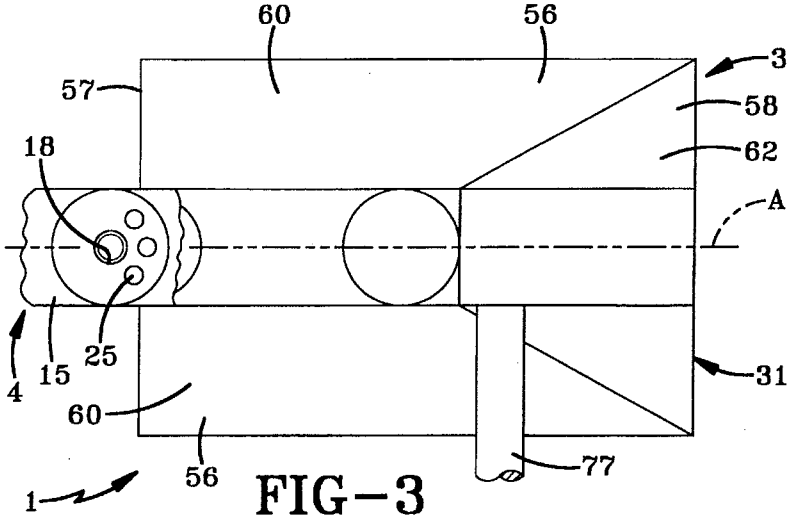
Figure 4:
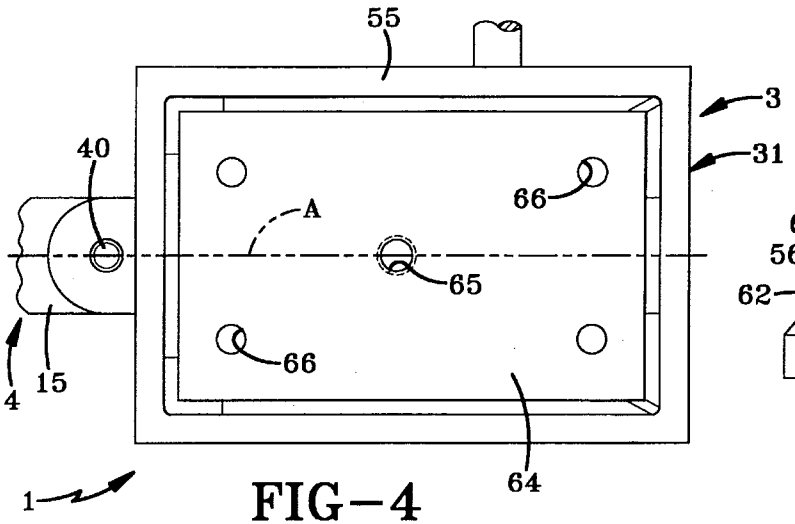
Figure 6:
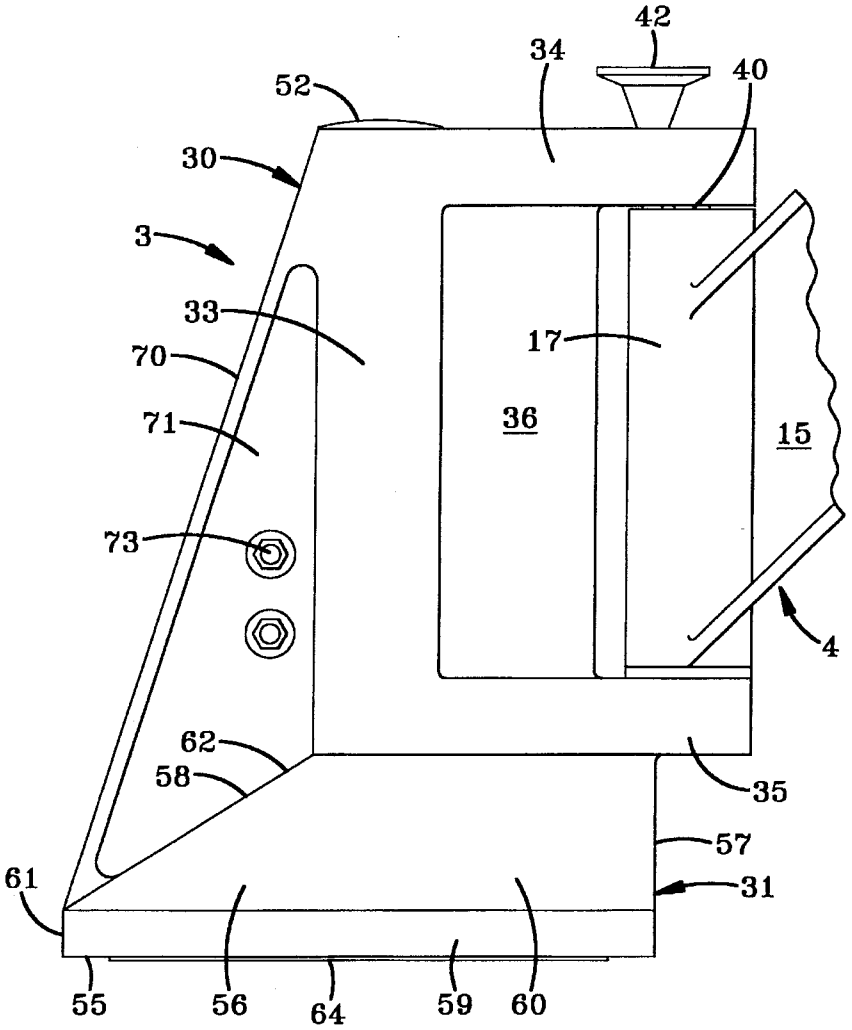
Figure 5:
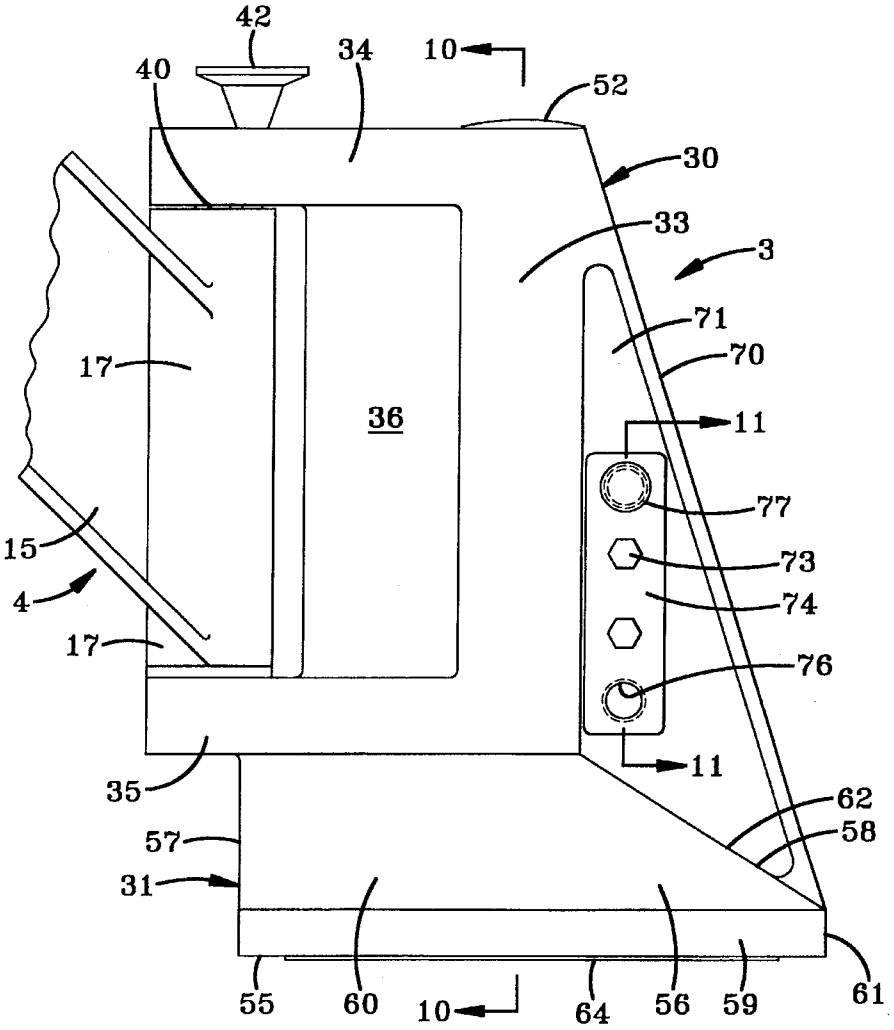
Figure 11:
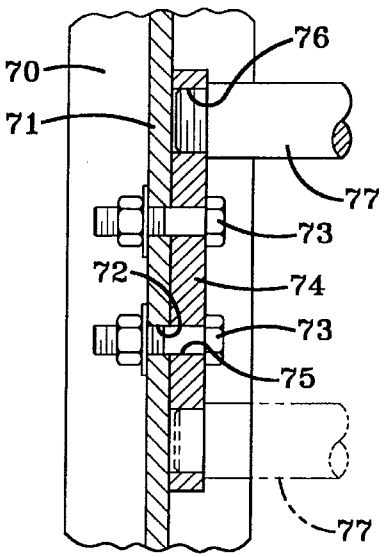
Figure 10:
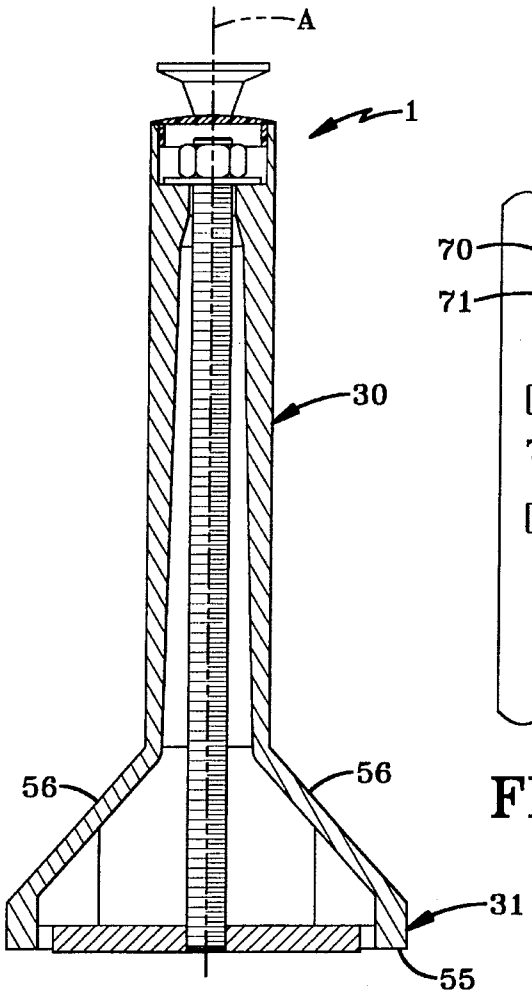
Figure 9:
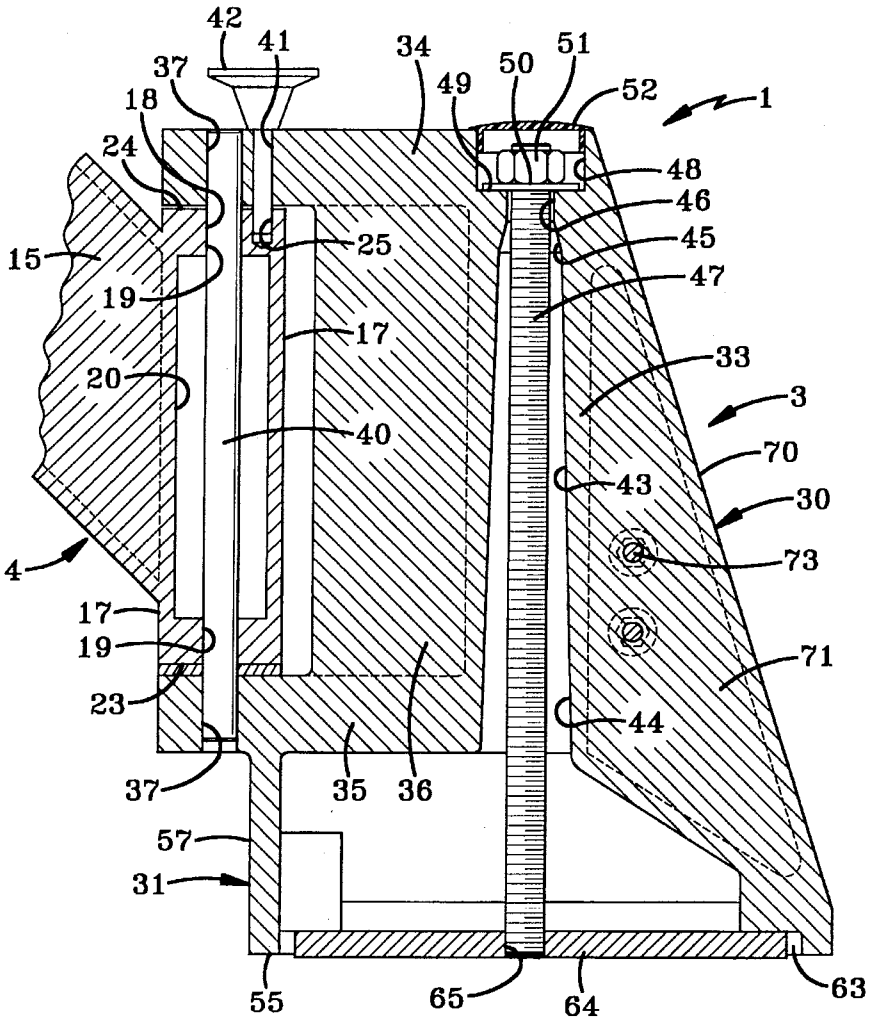

FIG, 3 is an enlarged fragmentary top view of the present invention with the seat and swing arm removed;

FIG. 4 is an enlarged fragmentary bottom view of FIG. 3;

FIG. 5 is a fragmentary elevational view of one side of FIG. 3;

FIG. 6 is a fragmentary elevational view of a second side of FIG. 3;

FIG. 7 is an elevational view of one end of the present invention of FIG. 3;

FIG. 8 is a second end elevational view of FIG. 3 with portions shown in section;

FIG. 9 is a sectional view taken substantially along line 9—9, FIG. 7;

FIG. 10 is a sectional view taken substantially along line 10—10 FIG. 5; and FIG. 11 is an enlarged fragmentary sectional view taken substantially along line 11—11, FIG. 5.

Similar numerals refer to similar parts throughout the drawings.

DESCRIPTION OF THE PREFERRED EMBODIMENT

Figure 2:
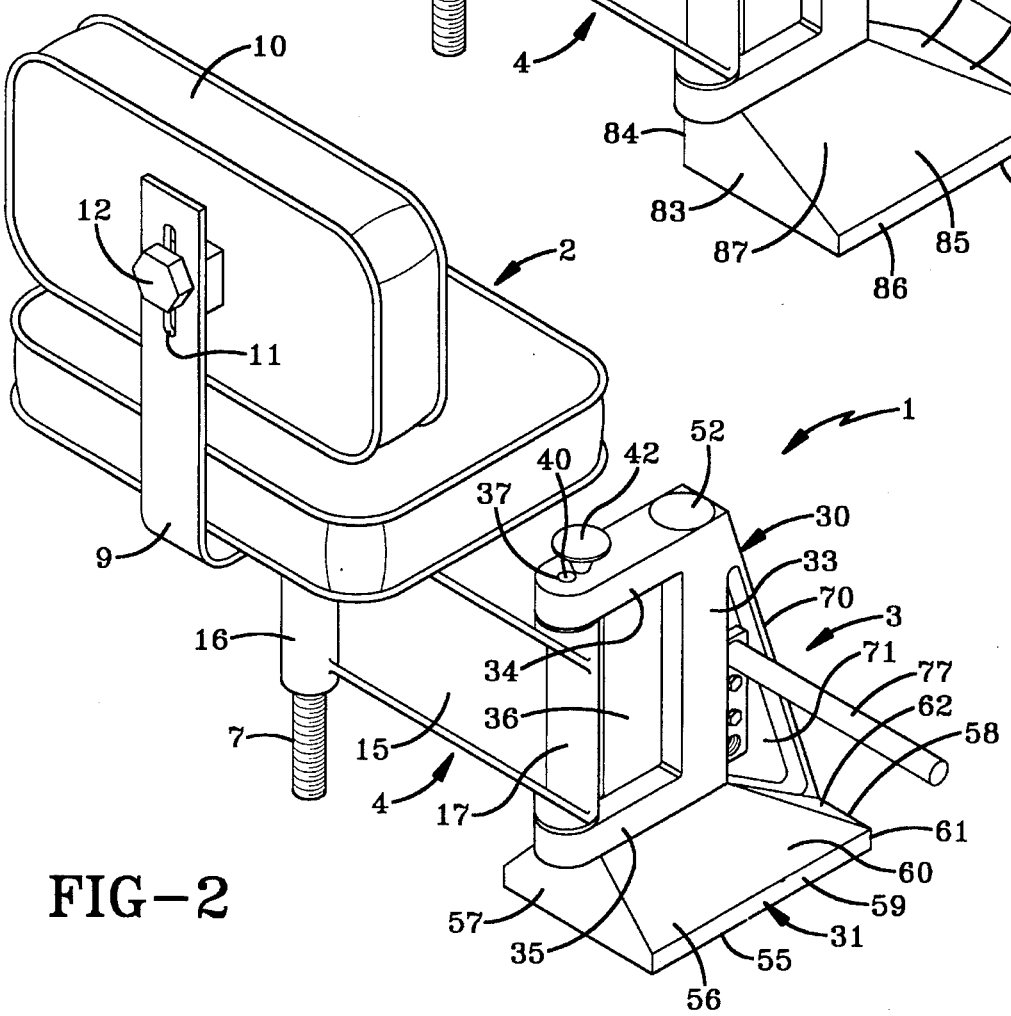
FIG. 2 is a perspective view of the pedestal seat of the present invention.

The pedestal seat of the present invention is indicated generally at 1, and is shown particularly in FIG. 2. Pedestal seat 1 includes as its main components a seat 2, a pedestal 3 and a support or swing arm 4.

Seat 2 (FIG. 2) includes a cushion 6 with a threaded rod 7 extending outwardly from the bottom thereof. A back support bracket 9 is attached to the bottom surface of cushion 6, and to a back support 10. Back support bracket 9 includes an elongated slot 11 for slidably receiving a hand wheel 12 for providing adjustment of back support 10 relative to cushion 6. While cushion 6 and back support 10 may take a variety of sizes and configurations, they are preferably rectangular, and are padded for the user's comfort.

Swing arm 4 includes a central beam 15 having one end terminating at a cylindrical top boss 16 for threadably receiving threaded rod 7 of seat 2 therein for adjusting the seat height. A lower end of central beam 15 terminates at a cylindrical mounting boss 17 which is formed with an axially extending bore 18 (FIG. 9) with reduced diameter upper and lower end portions 19, and a wider center portion 20. Mounting boss 17 also includes an annular bottom surface 23, and an annular top surface 24 which is formed with three blind holes 25 as shown in FIG. 3, the purpose for which will be described in detail below. Both bosses 16 and 17 are welded to central beam 15 and are vertical and parallel with each other with central beam 15 extending obliquely therebetween.

In accordance with one of the main features of the invention, pedestal 3 includes a vertical column 30, and a base 31. Column 30 is integrally formed with base 31 at a lower end thereof. Column 30 has a reverse generally C-shape (FIGS. 2 and 9) which includes a main vertical post 33, and a pair of horizontal legs 34 and 35. A web of reduced material thickness 36 extends between legs 34 and 35 and vertical post 33 to strengthen column 30. The end of each leg 34 and 35 is formed with a through hole 37 (FIG. 9), which holes are in axial alignment with holes 18 of mounting boss 17. Axially aligned holes 18 and 37 receive a pivot pin 40. Pivot pin 40 is interferencly fitted into holes 37 and slip fitted within holes 18 to provide rotational movement of swing arm 4 on pivot pin 40.

Top leg 34 of column 30 includes a second through hole 41 (FIG. 9) for receiving a lock pin 42 therein. Hole 41 will axially align with one of the three blind holes 25 depending on the rotated position of arm 4 relative to pedestal 3. As swing arm 4 is rotated, each of the three blind holes 25 will move into and subsequently out of axial alignment with hole 41. When the user has located a comfortable seat position, lock pin 42 is passed through hole 41 and into an aligned hole 25 to prevent further rotation of arm 4 relative to pedestal 3.

Vertical post 33 (FIG. 9) of column 30 includes a frustaconical aperture 43 having an enlarged bottom end 44 adjacent base 31, and a smaller upper end 45. An uppermost portion 46 of aperture 43 is cylindrical and nearly identical to, but slightly larger than, the diameter of a threaded bolt 47. An upper hole 48 is formed at the juncture of post 33 and top leg 34 and joins with portion 46 at a shoulder 49. Bolt 47 extends through uppermost portion 46 and into upper hole 48 and receives a washer 50 and nut 51 thereon. A plastic cap 52 frictionally engages the interior of upper hole 48 to conceal bolt 47, washer 50 and nut 51.

In further accordance with one of the main features of the present invention, base 31 is symmetrical about a vertical plane A which passes through column 30 and base 31. Base 31 is hollow and includes a peripheral bottom wall 55, a pair of tapered sidewalls 56, a first end wall 57 and a second end wall 58, such that base 31 has a substantially triangular cross-section transverse to plane A (FIGS. 2 and 9). Each sidewall 56 is formed with a vertical bottom edge portion 59 adjacent bottom wall 55, and an inclined upper portion 60 extending upwardly from vertical portion 59 and inwardly toward column 30. Similarly, second end wall 58 includes a vertical bottom portion 61, and an inclined portion 62 extending upwardly from vertical portion 61 and inwardly toward column 30. First end wall 57 differs from second end wall 58 and sidewalls 56 in that it is substantially vertical and does not include an inclined portion and extends transverse to plane A. Pedestal 3 is a one-piece member with column 30 being formed integrally with base 31, and column 30 cantilevers over and extends beyond end wall 57.

Bottom wall 55 of base 31 forms a rectangular shaped opening 63 in which is mounted a complementary shaped mounting plate 64. Plate 64 is formed with four mounting holes 66 (FIG. 4) for attaching the plate and base 31 to the floor by bolts or other convenient attachment means. Bolt 47 threadably engages mounting base 64 at a central threaded hole 65 (FIGS. 4 and 9) and when nut 51 is tightened securely clamps pedestal 3 on mounting plate 64 and a support surface.

In accordance with another main feature of the present invention, column 30 is further connected to base 31 by a generally triangular shaped reinforcement member which includes a reinforcing flange 70 and a web 71. Flange 70 is formed integrally with column 30 and base 31 and inclines upwardly away from second end wall 58 of base 31 toward leg 34 of column 30 for adding strength to pedestal 3. Web 71 of reduced material thickness extends between flange 70, vertical post 33 and second end wall 58. Plane A also extends through the center of flange 70 and web 71 to provide the desired symmetry.

Referring to FIG. 11, web 71 is formed with a pair of holes 72, and a rectangular footrest mounting plate 74 which is formed with a pair of holes 75 that align with holes 72. Plate 74 is bolted to web 71 by a pair of bolts 73 which extend through aligned holes 72 and 75 to secure the mounting plate to web 71. Mounting plate 74 is also formed with a pair of threaded holes 76, each of which is sized to receive a threaded end of a footrest bar 77. Footrest bar 77 may be conveniently positioned in either of the threaded holes 76 to customize the height of footrest bar 77 to the specific user. Mounting plate 74 can be mounted on either side of web 71 to provide a footrest bar 77 on either side of pedestal 3 depending upon the position of pedestal seat 1 with respect to a work station.

The symmetry of pedestal 3 reduces the rotational moment of seat 2 about pedestal 3 whether the seat is positioned on the right side or left side of pedestal 3. The inclined portions 60 of sidewalls 56 significantly reduce the rotational moment by reducing the lever arm through which the user's weight acts, and thus significantly reduces the force on pedestal 3. Inasmuch as each sidewall 56 is inclined outwardly in a symmetrical manner from column 30 of pedestal 3, the seat may be positioned on either side of column 30 while maintaining a constant, reduced, rotational moment about base 31.

Additionally, reinforcing flange 70 and web 71 extend outwardly and downwardly from top leg 34 of column 30 toward second end wall 58 of base 31 to transfer the cantilever force acting on column 30 to base 31, and subsequently to the floor on which pedestal seat 1 is mounted. As such, the combination of flange 70, and web 71 with symmetrical base 31 which extends equally outwardly on either side of plane A, combine to create a pedestal which permits the seat to be positioned on either the right side or the left side of the pedestal without creating unsafe torsional forces thereon.

If seat 2 is positioned on the right side of pedestal 3, then footrest bar 77 is installed in the position shown in FIG. 2. However, if seat 2 is rotated to the left hand side of pedestal 3, then bolts 73 can be removed from holes 72, and mounting plate 74 and associated footrest bar 77 is moved to the opposite side of web 71. Thereafter, bolts 73 are reinserted into axially aligned holes 72 and 75 to resecure mounting plate 74 to web 71. In this manner, both the seat and the footrest may be positioned on either side of pedestal 3 without the need for stocking right handed and left handed pedestals.

Seat 2 is rotated about pedestal 3 via the rotational engagement of pin 40 and mounting boss 17. Once chair 2 has been rotated to the selected position, lock pin 42 is dropped through hole 41 and into one of the appropriately aligned holes 25 formed in mounting boss 17.

Figure 1:
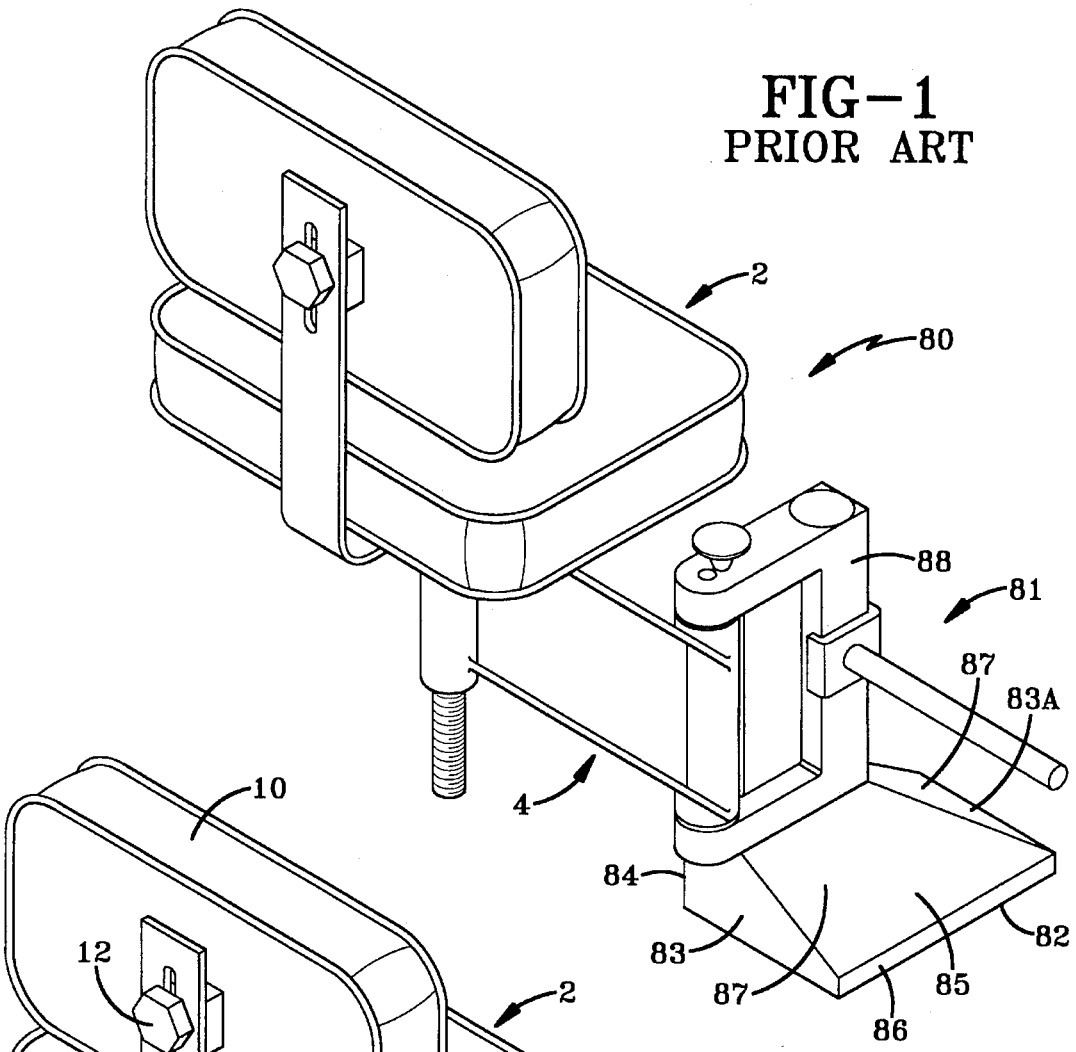
FIG-1 PRIOR ART
FIG. 1 is a perspective view of a prior art pedestal seat.

Referring to the prior art pedestal seat 80 shown generally in FIG. 1, pedestal seat 80 includes a seat 2 and support arm 4 identical to seat 2 and support arm 4 of the present invention. However, pedestal seat 80 includes a pedestal 81 which differs significantly from pedestal 3 of the present invention. Pedestal 81 includes a bottom wall 82, and a first end 83 and a first side 84 extending vertically upwardly from bottom wall 82. A second end 83A and second side 85 each include a vertical portion 86 and an inclined portion 87 inclined upwardly from vertical portion 86 toward an upper portion 88. Prior art pedestal seat 80 does not include a reinforcing flange 70 and associated web 71 as does pedestal 3. Most significantly, pedestal 81 is not symmetrical about a vertical plane which passes through the center of the support column as in the present invention. This prevents the pedestal seat from being used both in a right and left hand mounting arrangement.

A review of the prior art shows that when chair 2 is positioned on the same side of pedestal 81 as inclined portion 87 of second side 85, then the rotational moment created by the user's weight on seat 2 will be reduced. However, if seat 2 is rotated outwardly and over the vertical first side 81, the user's weight will create an unsafe torsional moment about pedestal 81. The prior art pedestal seat 80 thus requires the use of two separate pedestals 81, a first pedestal for right hand mounted left swing seats, and a second pedestal for left hand mounted right swing seats. The present invention successfully obviates the need for the use of separate pedestals for specific mounting environments.

In summary, pedestal seat 1 may be used when the pedestal 3 is left mounted and seat 2 swings right, as well as when pedestal 3 is right mounted and seat 2 swings left. This is accomplished via the symmetrical sides of the base which incline upwardly and inwardly from bottom wall 55 as well as from the additional torsional support added by reinforcing flange 70 and web 71. Again base 31, column 30, reinforcing flange 70 and web 71 are symmetrical with respect to vertical plane A which passes through the center of column 30.

In the preferred embodiment, base 31 and in particular rectangular bottom wall 55, will have a width of approximately ¾ the height of column 30, which height is approximately equal to the length of base 31.

Accordingly, the improved pedestal seat provides an effective, safe, inexpensive, and efficient device which achieves all of the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved pedestal seat is constructed and used, the characteristics of the construction, and the advantages, new and useful results obtained; the new and useful structures, devices, elements, arrangements, parts and combinations, are set forth in the appended claims.

We claim:

1. A pedestal seat including:

a pedestal having a base adapted to be attached to a support surface, and a column extending vertically upwardly from said base;

the base having a pair of ends whereby one of the base ends is inclined outwardly and downwardly from the column;

a seat;

a swing arm connected to the seat;

pivot means for pivotally mounting the seat in a cantilever fashion on the pedestal by the swing arm;

said column and pivot means being located in a vertical plane which extends through a center of the base with said base being symmetrical about said plane, when the pedestal is attached to the support surface;

a reinforcing flange extends between said one base end and the column and is located in the plane and the column extending beyond an end of the base along said vertical plane.

2. The pedestal seat defined in claim 1 in which one of the base ends extends substantially vertically in a plane transverse to the vertical plane of the column.

3. The pedestal seat including:

a pedestal having a base adapted to be attached to a support surface, and a column extending vertically upwardly from said base;

a seat;

a swing arm connected to the seat;

pivot means for pivotally mounting the seat in a cantilever fashion on the pedestal of the swing arm;

said column and pivot means being located in a vertical plane which extends through a center of the base with said base being symmetrical about said plane, when the pedestal is attached to the support surface;

the base having a pair of sides inclined outwardly and downwardly from the column, and a pair of ends whereby one of the base ends is inclined outwardly and downwardly from the column; and a reinforcing flange extends between said one base end and the column and is located in said plane.

4. The pedestal seat defined in claim 3 in which a first reinforcing web extends between the reinforcing flange and column.

5. The pedestal seat defined in claim 4 in which the pivot means is located at a first end of the column; and in which the reinforcing flange and the first reinforcing web form a generally triangular shaped reinforcing member which connects a second end of the column located opposite of said first end, to the base.

6. The pedestal seat defined in claim 5 in which the width of the reinforcing flange is substantially equal to the width of the column.

7. The pedestal seat defined in claim 4 including a footrest mounted on the first reinforcing web.

8. The pedestal seat defined in claim 7 in which the footrest includes a mounting plate; in which the first reinforcing web is formed with a plurality of holes which extend between opposite sides of said first reinforcing web; and in which fasteners extend through said web holes to removably selectively mount the footrest plate on either side of said first reinforcing web.

9. The pedestal seat defined in claim 8 in which the mounting plate is formed with spaced holes; and in which a footrest bar is secured in a selected one of said spaced holes and extends outwardly therefrom to adjustably position the footrest bar on the column.

10. The pedestal seat defined in claim 3 in which the column is substantially C-shaped and includes spaced top and bottom legs and a connecting vertical end post; and in which the reinforcing flange extends in an outwardly downwardly inclined fashion from the top leg of the column to the base.

11. The pedestal seat defined in claim 10 in which a second reinforcing web extends between the spaced column legs and end post.

12. The pedestal seat defined in claim 10 in which the pivot means extends between the spaced column legs at an opposite end of the column from the reinforcing flange; in which a plurality of seat adjustment holes are formed in the top leg of the column adjacent the pivot means; and in which a lock pin extends through a selective one of said holes and into engagement with the pivot means to lock the seat and swing arm in a selected position.

13. The pedestal seat defined in claim 12 in which one of the seat adjustment holes is located in the vertical plane of the column; and in which certain others of said adjustment holes are located on opposite sides of said plane.

14. The pedestal seat defined in claim 10 in which the pivot means includes a vertical pin fixedly mounted in the spaced column legs and located in the vertical plane of the column.

15. The pedestal seat defined in claim 3 in which the sides and ends of the base form terminates in a rectangular bottom peripheral wall; in which the width of said bottom wall is approximately ¾ the height of the column; and in which the length of said bottom wall is substantially equal to the height of the column.

16. The pedestal seat defined in claim 3 in which the base and column is an integral one-piece member.

* * * * *